US010379553B2

(12) United States Patent
Chen

(10) Patent No.: US 10,379,553 B2
(45) Date of Patent: Aug. 13, 2019

(54) OVERCURRENT PROTECTION CIRCUIT, DISPLAY PANEL, AND DISPLAY DEVICE

(71) Applicants: HKC Corporation Limited, Shenzhen, Guangdong (CN); Chongqing HKC Optoelectronics Technology Co., Ltd., Chongqing (CN)

(72) Inventor: Yu-Jen Chen, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 1 day.

(21) Appl. No.: 15/557,810

(22) PCT Filed: May 26, 2017

(86) PCT No.: PCT/CN2017/086115

§ 371 (c)(1),
(2) Date: Sep. 12, 2017

(87) PCT Pub. No.: WO2018/188175

PCT Pub. Date: Oct. 18, 2018

(65) Prior Publication Data

US 2018/0292850 A1 Oct. 11, 2018

(30) Foreign Application Priority Data

Apr. 11, 2017 (CN) ..... 2017 1 0233765

(51) Int. Cl.
*G05F 1/56* (2006.01)
*G09G 5/00* (2006.01)

(52) U.S. Cl.
CPC ..... *G05F 1/56* (2013.01); *G09G 5/003* (2013.01); *G09G 2310/0267* (2013.01);
(Continued)

(58) Field of Classification Search
None
See application file for complete search history.

(56) References Cited

U.S. PATENT DOCUMENTS

2007/0279023 A1* 12/2007 Zhao ..... H02M 3/07 323/273
2009/0140709 A1* 6/2009 Dong ..... G05F 1/573 323/283

FOREIGN PATENT DOCUMENTS

CN 101206836 A 6/2008
CN 201854007 U 6/2011
(Continued)

OTHER PUBLICATIONS

International Search Report of PCT Patent Application No. PCT/CN2017/086115 dated Jan. 11, 2018.

*Primary Examiner* — Kenneth B Lee, Jr.

(57) ABSTRACT

Disclosed is an overcurrent protection circuit including a voltage conversion unit, a reference voltage generation unit, a voltage comparison unit and a switch unit. The voltage conversion unit is configured to receive an input voltage and converting the input voltage into a modulated voltage; the reference voltage generation unit is configured to generate a reference voltage to be compared with the modulated voltage; the voltage comparison unit is electrically connected to the voltage conversion unit and the reference voltage generation unit for comparing the modulated voltage with the reference voltage to generate a control signal; the switch unit is electrically connected to the voltage comparison unit and the voltage conversion unit configured to determine whether or not to output the modulated voltage according to the control signal.

16 Claims, 2 Drawing Sheets

(52) U.S. Cl.
CPC . *G09G 2330/025* (2013.01); *G09G 2330/028* (2013.01); *G09G 2330/045* (2013.01)

(56) References Cited

FOREIGN PATENT DOCUMENTS

| | | | |
|---|---|---|---|
| CN | 102323551 | A | 1/2012 |
| CN | 103247280 | A | 8/2013 |
| CN | 103869858 | A | 6/2014 |
| CN | 104102260 | A | 10/2014 |
| CN | 203933395 | U | 11/2014 |
| CN | 104235803 | A | 12/2014 |
| CN | 105223713 | A | 1/2016 |
| CN | 105304050 | A | 2/2016 |
| CN | 106209041 | A | 12/2016 |

* cited by examiner

OVERCURRENT PROTECTION CIRCUIT, DISPLAY PANEL, AND DISPLAY DEVICE

FIELD OF INVENTION

The present invention relates to the technical field of displays, in particular to an overcurrent protection circuit, a display panel, and a display device.

BACKGROUND OF INVENTION

1. Description of the Related Art

Thin Film Transistor Liquid Crystal Display (TFT-LCD) display device is one of the main types of panel displays at present. In the principle of driving a TFT-LCD display device, a system board connects R/G/B comprised signals, control signals and power to a connector of a control board through electric wires. After data are processed by a timing controller (TCON) installed on the control board, the data are transmitted to a Printed Circuit Board (PCB) through a Flexible Flat Cable (FFC), and the circuits of a Source-Chip on Film (S-COF) and a Gate-Chip on Film (G-COF) are connected to a display area of a display panel to obtain the required power source and signal of the display panel.

Wherein, the G-COF circuit of the display panel fan-out area includes high-voltage signal circuits including the circuits of a gate ON voltage, a gate OFF voltage, a reference voltage, so that short circuits may occur easily due to the foreign substances in the manufacturing process, and a large current signal is generated to heat up the display panel or even burn or damage the display panel.

2. Summary of the Invention

Therefore, it is a primary objective of the present invention to overcome the drawbacks of the prior art by providing an overcurrent protection circuit, a display panel and a display device with simple structure and high reliability.

To achieve the aforementioned and other objectives, the present invention provides an overcurrent protection circuit, comprising:

a voltage conversion unit, configured to receive an input voltage and converting the input voltage into a modulated voltage;

a reference voltage generation unit, configured to generate a reference voltage for comparing the modulated voltage;

a voltage comparison unit, electrically coupled to the voltage conversion unit and the reference voltage generation unit, configured to compare the modulated voltage with the reference voltage, so as to generate a corresponding control signal; and a switch unit, electrically coupled to the voltage comparison unit and the voltage conversion unit, configured to determine whether or not to output the modulated voltage according to the control signal.

To achieve the aforementioned and other objectives, the present invention further provides a display panel comprising a display area and a fan-out area, and the fan-out area has a gate scan driving circuit installed thereon, and an overcurrent protection circuit electrically coupled to the gate scan driving circuit, and the overcurrent protection circuit comprises:

a voltage conversion unit, configured to receive an input voltage and converting the input voltage into a modulated voltage;

a reference voltage generation unit, configured to generate a reference voltage for comparing the modulated voltage;

a voltage comparison unit, electrically coupled to the voltage conversion unit and the reference voltage generation unit, configured to compare the modulated voltage with the reference voltage, so as to generate a corresponding control signal; and a switch unit, electrically coupled to the voltage comparison unit and the voltage conversion unit, configured to determine whether or not to output the modulated voltage according to the control signal.

To achieve the aforementioned and other objectives, the present invention further provides a display device, comprising a housing and a display panel fixed into the housing, and the display panel comprising a display area and a fan-out area, and the fan-out area having a gate scan driving circuit installed thereon and an overcurrent protection circuit electrically coupled the gate scan driving circuit, and the overcurrent protection circuit comprising: a voltage conversion unit, configured to receive an input voltage and converting the input voltage into a modulated voltage; a reference voltage generation unit, configured to generate a reference voltage for comparing the modulated voltage; a voltage comparison unit, electrically coupled to the voltage conversion unit and the reference voltage generation unit, configured to compare the modulated voltage with the reference voltage, so as to generate a corresponding control signal; and a switch unit, electrically coupled to the voltage comparison unit and the voltage conversion unit, configured to determine whether or not to output the modulated voltage according to the control signal.

In an embodiment of the present invention, the voltage comparison unit compares the reference voltage with the modulated voltage to generate the control signal, and the switch unit determines whether or not to output the modulated voltage according to the control signal. The present invention can prevent circuits from being burned or damaged by short circuit.

BRIEF DESCRIPTION OF THE DRAWINGS

The above and other objects, features and advantages of this disclosure will become apparent from the following detailed description taken with the accompanying drawings. It is noteworthy that the drawings are provided for the purpose of illustrating the invention and other drawings may be obtained without any creative labor by persons having ordinary skill in the art.

DESCRIPTION OF THE PREFERRED EMBODIMENTS

It is noteworthy that the embodiments are provided for the purpose of illustrating the present invention, but not intended for limiting the scope of the invention, and this specification uses an open-ended term "comprising" meaning that the claim encompasses all the elements listed, but may also include additional unnamed elements.

Figure 1:
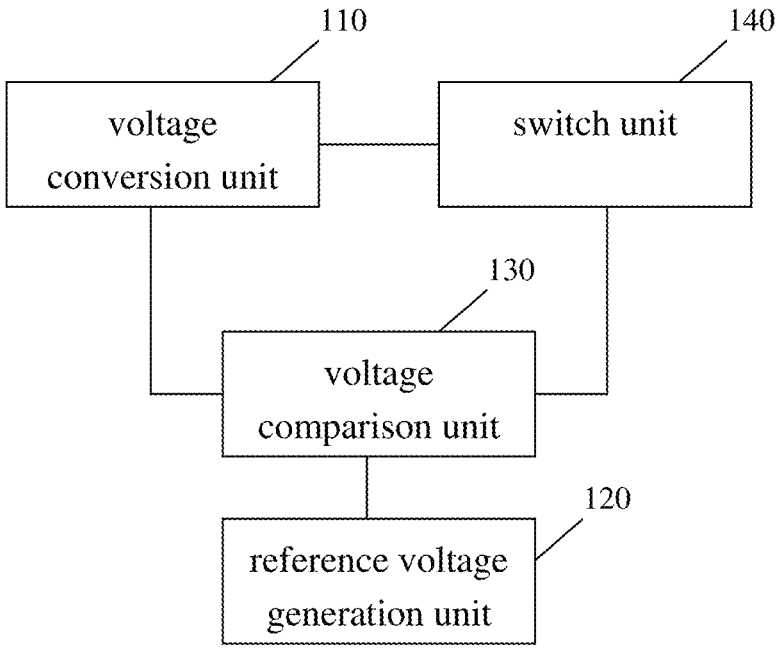
FIG. 1 is a block diagram showing the principle of an overcome protection circuit in accordance with an embodiment of the present invention.
Figure 2:
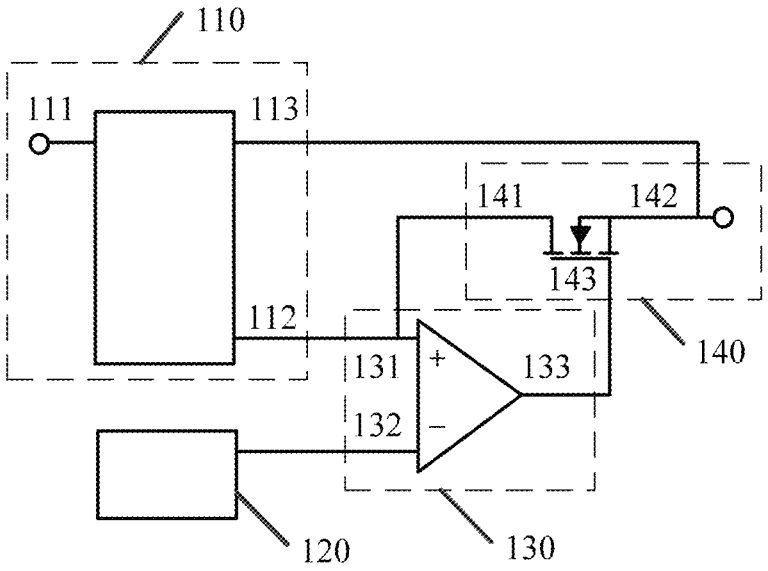
FIG. 2 is a schematic circuit diagram of an overcome protection circuit in accordance with an embodiment of the present invention.

With reference to FIGS. 1 and 2 for a block diagram and a schematic view of an overcurrent protection circuit in accordance with an embodiment of the present invention respectively, the overcurrent protection circuit comprises a voltage conversion unit 110, reference voltage generation unit 120, voltage comparison unit 130 and switch unit 140.

The voltage conversion unit 110 is configured to receive input voltage and converting the input voltage into a modulated voltage.

In an embodiment, the voltage conversion unit 110 comprises a converted voltage input terminal 111, and a converted voltage output terminal 112. The converted voltage input terminal 111 is configured to receive an input voltage, and the converted voltage output terminal 112 is configured to output the modulated voltage.

Wherein, the output power of the voltage conversion unit 110 is constant. The larger the modulated voltage outputted from the converted voltage output terminal 112, the smaller the outputted modulated current outputted from the corresponding converted voltage output terminal 112. The voltage conversion unit 110 is a pulse width modulation chip.

The reference voltage generation unit 120 is configured to generate a reference voltage used to be compared with the modulated voltage.

The voltage comparison unit 130 is electrically coupled to the voltage conversion unit 110 and the reference voltage generation unit 120 and is configured to compare the modulated voltage with the reference voltage, so as to generate a corresponding control signal.

In an embodiment, the voltage comparison unit 130 is a voltage comparator comprising a non-inverting input terminal 131, an inverting input terminal 132 and a signal output terminal 133.

The non-inverting input terminal 131 is electrically coupled to the voltage conversion unit 110 and configured to receive the modulated voltage; the inverting input terminal 132 is electrically coupled to the reference voltage generation unit 120 and configured to receive the reference voltage; and the signal output terminal 133 is electrically coupled to the switch unit 140 and is configured to output the control signal.

When the non-inverting input terminal 131 has a voltage greater than the voltage of the inverting input terminal 132, the signal output terminal 133 will output a high level control signal. When the non-inverting input terminal 131 has a voltage smaller than the voltage of the inverting input terminal 132, the signal output terminal 133 will output a low level control signal.

The switch unit 140 is electrically coupled to the voltage comparison unit 130 and the voltage conversion unit 110 and is configured to determine whether or not to output the modulated voltage according to the control signal.

In an embodiment, the switch unit 140 comprises a switch input terminal 141, a switch output terminal 142, and a switch control terminal 143.

The switch input terminal 141 is electrically coupled to the voltage conversion unit 110 and configured to receive the modulated voltage.

The switch output terminal 142 is configured to output the modulated voltage.

The switch control terminal 143 is electrically coupled to the voltage comparison unit 130 and configured to receive the control signal and confirming a switch status of the switch unit 140 according to the control signal, wherein the switch status includes a conduction status and a cut-off status.

In an embodiment, the switch unit 140 is a metal oxide semiconductor field effect transistor (MOSFET) which may be an n-channel MOSFET. Specifically, the MOSFET includes a gate, a source, and a drain. In an embodiment of the present invention, the gate serves as the switch control terminal 143; the source serves as the switch input terminal 141 or switch output terminal 142; and the drain serves as the switch input terminal 141 or switch output terminal 142.

When the control signal is a high level control signal, the switch status will be determined as a conduction status, and the switch output terminal 142 will output the modulated voltage. When the control signal is a low level control signal, the switch status will be determined as a cut-off status, and the switch output terminal 142 will not output the modulated voltage. For example, if the circuit has a short circuit or an overcurrent, the increase of current in the circuit will cause a decrease of the modulated voltage. When the modulated voltage is lower than the reference voltage, the voltage comparator will output a low level voltage to the switch unit 140, and maintains the switch unit 140 in the cut-off status, so that the modulated voltage cannot be outputted to protect the circuit from being damaged by overcurrent.

In another embodiment, the overcurrent protection circuit further comprises a feedback unit electrically coupled to the voltage conversion unit 110, and the switch unit 140. Specifically, the voltage conversion unit 110 includes a feedback input terminal, and the feedback unit is electrically coupled to the voltage conversion unit 110 through the feedback input terminal, and the feedback unit is electrically coupled to the switch unit 140 through the switch output terminal 142.

In an embodiment, the feedback unit obtains a feedback voltage value of the switch output terminal 142 and feeds back the feedback voltage value to the voltage conversion unit 110, and the voltage conversion unit 110 determines whether or not the feedback voltage value falls within a predetermined range. If the feedback voltage value is not within the predetermined range, the voltage conversion unit 110 will stop outputting the modulated voltage. For example, the voltage conversion unit 110 outputs a modulated voltage of 30V, and if the circuit has a short circuit or an overcurrent, then the feedback voltage value will become smaller. If it is determined that the feedback voltage value is smaller than 28V, then the circuit will be determined to be having a short circuit or an overcurrent, and the voltage conversion unit 110 will stop outputting the modulated voltage to prevent the circuit from being burned or damaged.

Figure 3:
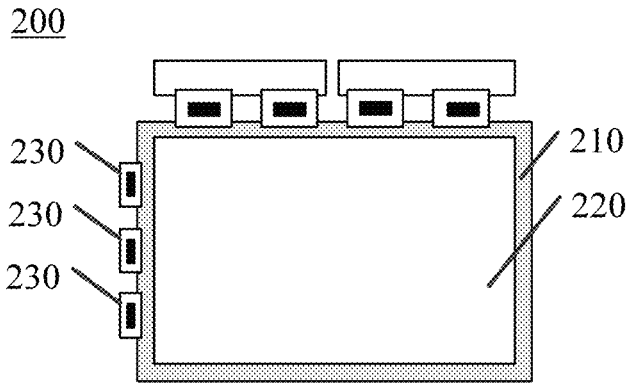
FIG. 3 is a schematic view of a display panel in accordance with an embodiment of the present invention.

With reference to FIG. 3 for a schematic view of a display panel in accordance with an embodiment of the present invention, the display panel 200 comprises a display area 220 and a fan-out area 210, and the fan-out area 210 has a gate scan driving circuit 230 installed thereon and an overcurrent protection circuit electrically coupled to the gate scan driving circuit 230. Wherein, the display panel 200 includes but not limited to a liquid crystal display (LCD) panel, an organic liquid emitting diode (OLED) display panel, a field emission display (FED) panel, a plasma display panel (PDP), and a curved surface panel such as a thin film transistor-liquid crystal display (TFT-LCD) panel, a twisted nematic+film (TN) panel, a vertical alignment (VA) panel, an in plane switching (IPS) panel, or a color filter on array (COA) panel, etc.

With reference to FIGS. 1 and 2 for the block diagram and schematic view of an overcurrent protection circuit in accordance with an embodiment of the present invention respectively, the overcurrent protection circuit comprises a voltage conversion unit 110, a reference voltage generation unit 120, a voltage comparison unit 130 and a switch unit 140.

The voltage conversion unit 110 is configured to receive an input voltage and converting the input voltage into a modulated voltage.

In an embodiment, the voltage conversion unit 110 comprises a converted voltage input terminal 111, and a converted voltage output terminal 112. The converted voltage input terminal 111 is configured to receive the input voltage, and the converted voltage output terminal 112 is configured to output the modulated voltage.

Wherein, the output power of the voltage conversion unit 110 is constant. The larger the modulated voltage outputted from the converted voltage output terminal 112, the smaller the modulated current outputted from the corresponding converted voltage output terminal 112. The voltage conversion unit 110 is a pulse width modulation chip.

The reference voltage generation unit 120 is configured to generate a reference voltage used to be compared with the modulated voltage.

The voltage comparison unit 130 is electrically coupled to the voltage conversion unit 110 and the reference voltage generation unit 120 and is configured to compare the modulated voltage with the reference voltage, so as to generate a corresponding control signal.

In an embodiment, the voltage comparison unit 130 is a voltage comparator comprising a non-inverting input terminal 131, an inverting input terminal 132 and a signal output terminal 133.

The non-inverting input terminal 131 is electrically coupled to the voltage conversion unit 110 and configured to receive the modulated voltage; the inverting input terminal 132 is electrically coupled to the reference voltage generation unit 120 and configured to receive the reference voltage; and the signal output terminal 133 is electrically coupled to the switch unit 140 and configured to output the control signal.

When the non-inverting input terminal 131 has a voltage greater than the voltage of the inverting input terminal 132, the signal output terminal 133 will output a high level control signal; and when the non-inverting input terminal 131 has a voltage smaller than the voltage of the inverting input terminal 132, the signal output terminal 133 will output a low level control signal.

The switch unit 140 is electrically coupled to the voltage comparison unit 130 and the voltage conversion unit 110 and is configured to determine whether or not to output the modulated voltage according to the control signal.

In an embodiment, the switch unit 140 includes a switch input terminal 141, a switch output terminal 142 and a switch control terminal 143.

The switch input terminal 141 is electrically coupled to the voltage conversion unit 110 and configured to receive the modulated voltage.

The switch output terminal 142 is configured to output the modulated voltage.

The switch control terminal 143 is electrically coupled to the voltage comparison unit 130 and configured to receive the control signal and confirming a switch status of the switch unit 140 according to the control signal, wherein the switch status includes a conduction status and a cut-off status.

In an embodiment, the switch unit 140 is a metal oxide semiconductor field effect transistor which may be an n-channel MOSFET. Specifically, the MOSFET includes a gate, a source, and a drain. The gate serves as a switch control terminal 143; the source serves as a switch input terminal 141 or a switch output terminal 142; and the drain serves as a switch input terminal 141 or a switch output terminal 142.

When the control signal is a high level control signal, the switch status will be determined as a conduction status, and the switch output terminal 142 will output the modulated voltage. When the control signal is a low level control signal, the switch status will be determined as a cut-off status, and the switch output terminal 142 will not output the modulated voltage. For example, if the circuit has a short circuit or an overcurrent, the increase of current in the circuit will cause a decrease of the modulated voltage. When the modulated voltage is lower than the reference voltage, the voltage comparator will output a low level voltage to the switch unit 140 and maintain the switch unit 140 in the cut-off status, and the modulated voltage cannot be outputted to protect the circuit from being damaged by overcurrent.

In another embodiment, the overcurrent protection circuit further comprises a feedback unit electrically coupled to the voltage conversion unit 110 and the switch unit 140. Specifically, the voltage conversion unit 110 comprises a feedback input terminal, and the feedback unit is electrically coupled to the voltage conversion unit 110 through the feedback input terminal, and the feedback unit is electrically coupled to the switch unit 140 through the switch output terminal 142.

In an embodiment, the feedback unit obtains a feedback voltage value of the switch output terminal 142 and feeds back the feedback voltage value to the voltage conversion unit 110, and the voltage conversion unit 110 determines whether or not the feedback voltage value falls within a predetermined range. If the feedback voltage value is within the predetermined range, then the voltage conversion unit 110 will stop outputting the modulated voltage. For example, the voltage conversion unit 110 outputs a modulated voltage of 30V, and if the circuit has a short circuit or an overcurrent, then the feedback voltage value will become smaller. If the feedback voltage value is determined to be smaller than 28V, then it will be determined that the circuit has a short circuit or an overcurrent, and the voltage conversion unit 110 will stop outputting the modulated voltage to prevent the circuit from being burned or damaged.

Figure 4:
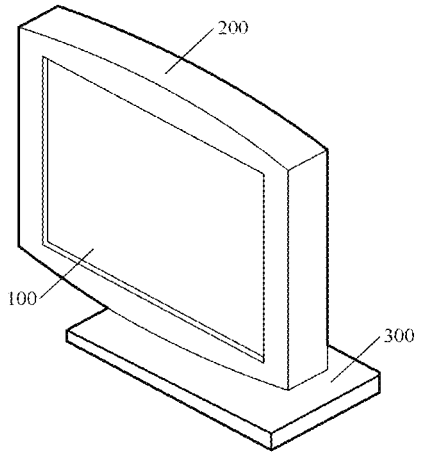
FIG. 4 is a schematic view of a display device in accordance with an embodiment of the present invention.

With reference to FIG. 4 for a schematic view of a display device in accordance with an embodiment of the present invention, the display device 900 comprises a housing 910 and a display panel 200 fixed into the housing 910, and the display panel comprises a display area 220 and a fan-out area 210, and the fan-out area 210 has a gate scan driving circuit 230 installed thereon, and an overcurrent protection circuit electrically coupled to the gate scan driving circuit 230.

In FIGS. 1 and 2, the overcurrent protection circuit comprises a voltage conversion unit 110, a reference voltage generation unit 120, a voltage comparison unit 130, and a switch unit 140.

The voltage conversion unit 110 is configured to receive input voltage and converting the input voltage into a modulated voltage.

In an embodiment, the voltage conversion unit 110 comprises a converted voltage input terminal 111, and a converted voltage output terminal 112. The converted voltage input terminal 111 is configured to receive the input voltage, and the converted voltage output terminal 112 is configured to output the modulated voltage.

Wherein, the output power of the voltage conversion unit 110 is constant. The larger the modulated voltage outputted from the converted voltage output terminal 112, the smaller the modulated current outputted from the converted voltage output terminal 112. The voltage conversion unit 110 is a pulse width modulation chip.

The reference voltage generation unit 120 is configured to generate a reference voltage to be compared with the modulated voltage.

The voltage comparison unit 130 is electrically coupled to the voltage conversion unit 110 and the reference voltage generation unit 120 and is configured to compare the modulated voltage with the reference voltage, so as to generate a corresponding control signal.

In an embodiment, the voltage comparison unit 130 is a voltage comparator comprising a non-inverting input terminal 131, an inverting input terminal 132, and a signal output terminal 133.

The non-inverting input terminal 131 is electrically coupled to the voltage conversion unit 110 and configured to receive the modulated voltage; the inverting input terminal 132 is electrically coupled to the reference voltage generation unit 120 and configured to receive the reference voltage; and the signal output terminal 133 is electrically coupled to the switch unit 140 and is configured to output the control signal.

When the non-inverting input terminal 131 has a voltage greater than the voltage of the inverting input terminal 132, the signal output terminal 133 will output a high level control signal; and when the non-inverting input terminal 131 has a voltage smaller than the voltage of the inverting input terminal 132, the signal output terminal 133 will output a low level control signal.

The switch unit 140 is electrically coupled to the voltage comparison unit 130 and the voltage conversion unit 110 and is configured to determine whether or not to output the modulated voltage according to the control signal.

In an embodiment, the switch unit 140 comprises a switch input terminal 141, a switch output terminal 142, and a switch control terminal 143.

The switch input terminal 141 is electrically coupled to the voltage conversion unit 110 and configured to receive the modulated voltage.

The switch output terminal 142 is configured to output the modulated voltage.

The switch control terminal 143 is electrically coupled to the voltage comparison unit 130 and configured to receive the control signal and confirming a switch status of the switch unit 140 according to the control signal, wherein the switch status includes a conduction status and a cut-off status.

In an embodiment, the switch unit 140 is a metal oxide semiconductor field effect transistor (MOSFET) which may be an n-channel MOSFET. Specifically, the MOSFET includes a gate, a source, and a drain. The gate serves as the switch control terminal 143; the source serves as the switch input terminal 141 or switch output terminal 142; and the drain serves as the switch input terminal 141 or switch output terminal 142.

When the control signal is a high level control signal, the switch status will be determined to be a conduction status, and the switch output terminal 142 will output the modulated voltage. When the control signal is a low level control signal, the switch status will be determined as a cut-off status, and the switch output terminal 142 will not output the modulated voltage. For example, if the circuit has a short circuit or an overcurrent, the increase of current in the circuit will cause a decrease of the modulated voltage. When the modulated voltage is lower than the reference voltage, the voltage comparator will output a low level voltage to the switch unit 140, and the switch unit 140 will maintain a cut-off status, so that the modulated voltage cannot be outputted to protect the circuit from being damaged by overcurrent.

In another embodiment, the overcurrent protection circuit further comprises a feedback unit electrically coupled to the voltage conversion unit 110, and the switch unit 140. Specifically, the voltage conversion unit 110 includes a feedback input terminal, and the feedback unit is electrically coupled to the voltage conversion unit 110 through the feedback input terminal, and the feedback unit is electrically coupled to the switch unit 140 through the switch output terminal 142.

In an embodiment, the feedback unit obtains a feedback voltage value of the switch output terminal 142 and feeds back the feedback voltage value to the voltage conversion unit 110, and the voltage conversion unit 110 determines whether or not the feedback voltage value falls within a predetermined range. If the feedback voltage value is not within the predetermined range, the voltage conversion unit 110 will stop outputting the modulated voltage. For example, the voltage conversion unit 110 outputs a modulated voltage of 30V, and if the circuit has a short circuit or an overcurrent, then the feedback voltage value will become smaller. If it is determined that the feedback voltage value is smaller than 28V, then the circuit will be determined to be having a short circuit or an overcurrent, and the voltage conversion unit 110 will stop outputting the modulated voltage to prevent the circuit from being burned or damaged.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An overcurrent protection circuit, comprising:

a voltage conversion unit, configured to receive an input voltage and convert the input voltage into a modulated voltage;

a reference voltage generation unit, configured to generate a reference voltage for comparing the modulated voltage;

a voltage comparison unit, electrically coupled to the voltage conversion unit and the reference voltage generation unit, and configured to compare the modulated voltage with the reference voltage, so as to generate a corresponding control signal; and a switch unit, electrically coupled to the voltage comparison unit and the voltage conversion unit, and configured to determine whether or not to output the modulated voltage according to the control signal;

wherein an output power of the voltage conversion unit is constant;

wherein the switch unit comprises:

a switch input terminal, electrically coupled to the voltage conversion unit, and configured to receive the modulated voltage;

a switch output terminal, configured to output the modulated voltage;

a switch control terminal, electrically coupled to the voltage comparison unit, and configured to receive the control signal and confirming a switch status information of the switch unit according to the control signal, wherein the switch status information includes a conduction status information and a cut-off status information;

wherein the overcurrent protection circuit further comprises a feedback unit electrically coupled to the voltage conversion unit and the switch unit wherein the feedback unit obtains a feedback voltage value of the switch output terminal and feeds back the feedback voltage value to the voltage conversion unit, and the voltage conversion unit determines whether or not the feedback voltage value falls within a predetermined range and stops outputting the modulated voltage when the feedback voltage value is within the predetermined range.

2. The overcurrent protection circuit of claim 1, wherein the voltage comparison unit is a voltage comparator comprising:

a non-inverting input terminal, electrically coupled to the voltage conversion unit, and configured to receive the modulated voltage;

an inverting input terminal, electrically coupled to the reference voltage generation unit, and configured to receive the reference voltage; and a signal output terminal, electrically coupled to the switch unit, and configured to output the control signal.

3. The overcurrent protection circuit of claim 2, wherein the signal output terminal is able to output a high level control signal when the non-inverting input terminal has a voltage greater than a voltage of the inverting input terminal; and the signal output terminal is able to output a low level control signal when the non-inverting input terminal has a voltage smaller than the voltage of the inverting input terminal.

4. The overcurrent protection circuit of claim 1, wherein the switch status is determined as a conduction status when the control signal is a high level control signal, and then the switch output terminal is able to output the modulated voltage; and the switch status is determined as a cut-off status when the control signal is a low level control signal, and then the switch output terminal is not able to output the modulated voltage.

5. The overcurrent protection circuit of claim 1, wherein the switch unit is a metal oxide semiconductor field effect transistor (MOSFET); and the MOSFET is an n-channel MOSFET.

6. The overcurrent protection circuit of claim 1, wherein the voltage conversion unit is a pulse width modulation chip.

7. A display panel, comprising a display area and a fan-out area, wherein the fan-out area comprises a gate scan driving circuit installed thereon and electrically coupled to an overcurrent protection circuit, and the overcurrent protection circuit comprising:

a voltage conversion unit, configured to receive an input voltage and converting the input voltage into a modulated voltage;

a reference voltage generation unit, configured to generate a reference voltage for comparing the modulated voltage;

a voltage comparison unit, electrically coupled to the voltage conversion unit and the reference voltage generation unit, and configured to compare the modulated voltage with the reference voltage, so as to generate a corresponding control signal; and a switch unit, electrically coupled to the voltage comparison unit and the voltage conversion unit, and configured to determine whether or not to output the modulated voltage according to the control signal;

wherein an output power of the voltage conversion unit is constant;

wherein the switch unit comprises:

a switch input terminal, electrically coupled to the voltage conversion unit, configured to receive the modulated voltage;

a switch output terminal, configured to output the modulated voltage;

a switch control terminal, electrically coupled to the voltage comparison unit, configured to receive the control signal and confirming a switch status of the switch unit according to the control signal, wherein the switch status includes a conduction status and a cut-off status;

wherein the overcurrent protection circuit further comprises a feedback unit electrically coupled to the voltage conversion unit and the switch unit wherein the feedback unit obtains a feedback voltage value of the switch output terminal and feeds back the feedback voltage value to the voltage conversion unit, and the voltage conversion unit determines whether or not the feedback voltage value falls within a predetermined range and stops outputting the modulated voltage when the feedback voltage value is within the predetermined range.

8. The display panel of claim 7, wherein the voltage comparison unit is a voltage comparator, comprising:

a non-inverting input terminal, electrically coupled to the voltage conversion unit, configured to receive the modulated voltage;

an inverting input terminal, electrically coupled to the reference voltage generation unit, configured to receive the reference voltage;

a signal output terminal, electrically coupled to the switch unit, configured to output the control signal.

9. The display panel of claim 8, wherein the signal output terminal is able to output a high level control signal when the non-inverting input terminal has a voltage greater than the voltage of the inverting input terminal; and the signal output terminal is able to output a low level control signal when the non-inverting input terminal has a voltage smaller than the voltage of the inverting input terminal.

10. The display panel of claim 7, wherein the switch status is determined as a conduction status when the control signal is a high level control signal, and then the switch output terminal is able to output the modulated voltage; and the switch status is determined as a cut-off status when the control signal is a low level control signal, and then the switch output terminal is not able to output the modulated voltage.

11. The display panel of claim 7, wherein the switch unit is a metal oxid semiconductor field effect transistor (MOSFET); the MOSFET is an n-channel MOSFET; and the voltage conversion unit is a pulse width modulation chip.

12. A display device, comprising a housing and a display panel fixed into the housing, wherein the display panel comprises a display area and a fan-out area, and the fan-out area having a gate scan driving circuit installed thereon and an overcurrent protection circuit electrically coupled the gate scan driving circuit, and the overcurrent protection circuit comprising:

a voltage conversion unit, configured to receive an input voltage and converting the input voltage into a modulated voltage;

a reference voltage generation unit, configured to generate a reference voltage for comparing the modulated voltage;

a voltage comparison unit, electrically coupled to the voltage conversion unit and the reference voltage generation unit, configured to compare the modulated voltage with the reference voltage, so as to generate a corresponding control signal; and a switch unit, electrically coupled to the voltage comparison unit and the voltage conversion unit, configured to determine whether or not to output the modulated voltage according to the control signal;

wherein an output power of the voltage conversion unit is constant;

wherein the switch unit comprises:

a switch input terminal, electrically coupled to the voltage conversion unit, configured to receive the modulated voltage;

a switch output terminal, configured to output the modulated voltage;

a switch control terminal, electrically coupled to the voltage comparison unit, configured to receive the control signal and confirming a switch status of the switch unit according to the control signal, wherein the switch status includes a conduction status and a cut-off status;

wherein the overcurrent protection circuit further comprises a feedback unit electrically coupled to the voltage conversion unit and the switch unit wherein the feedback unit obtains a feedback voltage value of the switch output terminal and feeds back the feedback voltage value to the voltage conversion unit, and the voltage conversion unit determines whether or not the feedback voltage value falls within a predetermined range and stops outputting the modulated voltage when the feedback voltage value is within the predetermined range.

13. The display device of claim 12, wherein the voltage comparison unit is a voltage comparator comprising:

a non-inverting input terminal, electrically coupled to the voltage conversion unit, configured to receive the modulated voltage;

an inverting input terminal, electrically coupled to the reference voltage generation unit, configured to receive the reference voltage; and a signal output terminal, electrically coupled to the switch unit, configured to output the control signal.

14. The display device of claim 13, wherein the signal output terminal is able to output a high level control signal when the non-inverting input terminal has a voltage greater than the voltage of the inverting input terminal; and the signal output terminal is able to output a low level control signal when the non-inverting input terminal has a voltage smaller than the voltage of the inverting input terminal.

15. The display device of claim 12, wherein the switch status is determined as a conduction status when the control signal is a high level control signal, and then the switch output terminal is able to output the modulated voltage; and the switch status is determined as a cut-off status when the control signal is a low level control signal, and then the switch output terminal is not able to output the modulated voltage.

16. The display device of claim 12, wherein the switch unit is a metal oxide semiconductor field effect transistor (MOSFET); the MOSFET is an n-channel MOSFET; and the voltage conversion unit is a pulse width modulation chip.

* * * * *